US005237703A

United States Patent [19]

Brine et al.

[11] Patent Number: 5,237,703

[45] Date of Patent: Aug. 24, 1993

[54] PROTECTIVE ATHLETIC GLOVE FOR CONTACT STICK SPORTS

[75] Inventors: Peter J. Brine, Hanover, N.H.; William H. Brine, III, Hopedale, Mass.

[73] Assignee: Sports Licensing, Incorporated, Hanover, N.H.

[21] Appl. No.: 859,990

[22] Filed: Mar. 30, 1992

[51] Int. Cl.[5] ..... A41D 13/10

[52] U.S. Cl. ..... 2/16

[58] Field of Search ..... 2/20, 163, 16, 161 A, 2/161 R, 159, 160, 158, 164, 18, 17, 21

[56] References Cited

U.S. PATENT DOCUMENTS

| | | | |
|---|---|---|---|
| D. 257,909 | 1/1981 | Brine | D2/361 |
| 3,601,117 | 9/1971 | Latina | 2/16 |
| 3,626,515 | 12/1971 | Murray | 2/16 |
| 4,137,572 | 2/1979 | Jansson et al. | 2/16 |
| 4,497,073 | 2/1985 | Deutsch | 2/16 |
| 4,524,464 | 6/1985 | Primiano et al. | 2/163 X |
| 4,766,612 | 8/1988 | Patton, Sr. | 2/163 X |
| 4,787,376 | 11/1988 | Eisenberg | 2/161 AX |
| 4,930,162 | 6/1990 | Cote | 2/161 |
| 5,072,459 | 12/1991 | Kogler | 2/161 |
| 5,108,221 | 5/1991 | Romandetto | 2/20 X |

FOREIGN PATENT DOCUMENTS

| | | | |
|---|---|---|---|
| 2210250 | 6/1989 | United Kingdom | 2/164 |

*Primary Examiner*—Clifford D. Crowder
*Assistant Examiner*—Sara M. Current
*Attorney, Agent, or Firm*—Barry R. Blaker

[57] ABSTRACT

Disclosed herein is a thumb protective construction for a protective athletic glove utilized in contact stick sports such as lacrosse and hockey. The construction involves a number of impact resistant protective stiffening components for the thumb receiving section and thumb stall of the glove which provide for enhanced thumb flexibility while preserving a full measure of impact protection for the thumb. Additionally disclosed is a stiffening component construction which fosters the establishment and maintenance of a correct grip position of the stick shaft between thumb and forefinger during play.

24 Claims, 4 Drawing Sheets

PROTECTIVE ATHLETIC GLOVE FOR CONTACT STICK SPORTS

FIELD OF THE INVENTION

This invention relates generally to protective athletic gloves for contact stick sports such as lacrosse and hockey and is more particularly concerned with an improved thumb protective construction for such gloves.

BACKGROUND OF THE INVENTION

In those contact sports wherein sticks are integral elements of the game, such as in lacrosse or hockey, it is important that the hands of the players be provided with adequate protection against the intensive stick strikes and other severe impacts which may be suffered during the course of play. The conventional hockey or lacrosse glove is constructed so as to provide finger stalls for the individual fingers of the hand and impact protective padding, now usually composed of a resilient polymeric foam composition, covering the dorsal surface of each finger and the back and sides of the hand. Normally, the protective padding is carried proximally of the hand, such by means of an attached cuff, so as to also afford protection to the wrist and at least the lower portion of the forearm. It is also known to utilize stiff, impact resistant sheet form elements as protective components in such glove padding constructions. Because the protective padding protocols employed often restrict flexibility and because the sport to which the protective glove is directed involves nearly continuous gripping of a stick element, it is also conventional to fabricate such gloves with segmented padding in order to somewhat improve hand and/or finger flexibility and with the finger stalls for the second through fifth fingers, in other words, the forefinger, middle finger, ring finger and pinky, in a precurled position such as to emulate the natural gripping position of the player's hands. Thus, gripping of the stick is made easier and more natural simply because the wearer of such a precurled glove construction need not first overcome the stiffness of the protective finger padding in closing these fingers over the stick shaft and thereby establishing a gripping relationship therewith.

Because the human thumb, or first finger, is in opposition to the remaining fingers of the hand and its skeletal structure is substantially different from that of the remaining fingers, the protective padding structures employed in the prior art, particularly those employing protective stiffening components, do not ordinarily provide adequate flexibility in the thumb portion of the glove. Typical of such thumb protective structures are those disclosed in U.S. Pat. No. 3,626,515, to Murray, issued Dec. 14, 1971 and U.S. Pat. No. 4,137,572, to Jansson et al., issued Feb. 6, 1979. In the Murray patent a thumb guard construction is disclosed comprising an elongate stiff unbreakable center or core insert sandwiched between layers of a shock absorbing material. The length of this monolithic thumb guard construction is shown to be sufficient as to cover both phalanges as well as at least a portion of the metacarpal of the thumb. Murray apparently recognizes the inflexible nature of this thumb guard construction and, in response thereto, does not attach it directly to the thumb encasing portion of the glove. Instead, the thumb encasing portion of the glove is rendered movable independently of the thumb guard by attachment thereto with a short strap. This means, however, that as the player's thumb is curled around the stick shaft in a gripping position, at least the distal portion of the thumb moves away from the overlying thumb guard and the protection afforded thereby. In the Jansson et al. patent a thumb protective element is disclosed which is similar in construction to the stiff elongate sandwich structure employed in Murray. In Jansson et al., however, this unarticulated stiff protective element extends proximally and uninterruptedly from the tip of the thumb stall into the wrist protective cuff thereof. In addition, the thumb protective element is stitched directly to the thumb stall of the glove. Thus, the thumb portion of the Jansson et al. glove appears to provide even less flexibility than that of the Murray glove.

In a proper grip of a contact sport stick element, whereby maximum control of and maximum application of power to the stick element is attained, it is generally desirable that the shaft of the stick as it enters the gripping hand be positioned within the thenar space of the palm; namely, the space defined between the fleshy palmar bulge at the base of the thumb and the base of the forefinger. This proper grip position can be more readily achieved when the thumb portion of a protective glove is provided with sufficient flexibility as to allow the thumb of the player to be readily curled around the shaft of the stick such that the stick shaft is positioned under the the proximal phalanx of the thumb. Such flexibility also provides greater facility when the player wishes to affirmatively loosen the stick within his or her grasp and to rotate or spin it to suit the particular playing task at hand. For instance, in the sport of lacrosse a player carrying the ball often loosens his or her grip and rapidly spins the stick or "crosse" about its longitudinal axis in order to impart centrifugal force to the ball, thereby to aid in maintaining the ball within the pocket of the network of the stick.

Another phenomenon related to the thumb anatomy of a player of a contact stick sport can occur when the stick of a player is violently contacted by the stick of an opposing player, such as commonly occurs in stick checking. Here, the thumb of the checked player can be generally construed for modelling purposes as defining a jointed reaction lever having its fulcrum at the base thereof. A checking force applied to the outer portion of the stick of the checked player can serve to displace the stick distally along the thumb of the checked player, thereby, in effect, to increase the moment arm of the reaction lever and the physical load imposed on the thumb's anatomical structure. The desired effect, of course, is to cause the checked player carrying the ball or puck to lose control thereof. An undesired effect, however, can be injury to the thumb. The increased effective leverage which results as the stick slips distally along the thumb poses a particular problem because, where this occurs, the checked player's already partially opened or loosened thumb, with continued application of the same or similar checking force to the outer portion of his or her stick, can be even more readily bent or displaced to the point of fracture, dislocation, sprain or other serious injury thereto. The present applicant is unaware of any prior art protective athletic glove construction which addresses this problem.

OBJECTS OF THE INVENTION

It is a principal object of the invention to provide a novel and improved protective athletic glove construction specifically adapted for use in contact stick sports.

It is another object of the invention to provide a glove of the type indicated comprising a novel thumb protective construction.

It is still another object of the invention to provide a glove of the type indicated comprising an improved thumb protective construction which provides flexibility while preserving impact protection of the thumb throughout the entire normal range of motion thereof.

It is yet another object of the invention to provide a glove of the type indicated comprising an improved thumb protective construction whereby establishment and maintenance of a proper grip of the player's stick between thumb and forefinger is fostered.

It is another object of the invention to provide a glove of the type indicated comprising an improved thumb protective construction which provides flexibility of motion while mitigating against injury due to levering of the protected thumb by the stick gripped therewith.

Other objects and advantages of the present invention will in part be obvious and will in part appear hereinafter.

SUMMARY OF THE INVENTION

In accordance with the invention, the thumb protective construction of a protective athletic glove comprises a number of sheet form impact resistant stiffening components which are disposed in the dorsal aspect of the thumb receiving section of the glove. The distal stiffening component of the construction is an elongate member of sufficient length as to overlie the two phalanges of the thumb. The proximal stiffening component comprises at least one elongate member of sufficient length as to overlie substantially the entire dorsal aspect of the metacarpal of the thumb. Said distal stiffening component is disposed and secured in the dorsal aspect of the thumb stall and said proximal stiffening component is disposed and secured in the dorsal aspect of the thumb receiving section of the glove in a spaced apart end to end relationship, thereby to define an articulated joint therebetween. Preferably, each of said distal and proximal stiffening components includes a corresponding overlayer element and, even more preferably, also an underlayer element, said overlayer and underlayer elements each being composed of a resilient shock absorbing padding material. An intermediate arcuately shaped stiffening component is disposed over and spaced above the articulated joint defined between the distal and proximal stiffening components. Said arcuately shaped third stiffening component is of sufficient length as to ensure that the articulated joint defined between the distal and proximal stiffening components disposed thereunder remains entirely protected by said intermediate component upon full flexure of said joint. In preferred embodiments of the invention said intermediate third stiffening component is secured to the base of the thumb stall of the glove, at the lateral margins thereof, and exteriorly of the glove shell. In another aspect of the invention, the interior lateral margin of the distal stiffener component comprises a medially (with respect to the thumb) indwelling bay located proximally from the distal end thereof at a level corresponding to the proximal phalanx of the thumb. Said medially indwelling bay is of a shape and size adapted to engage the shaft of a player's stick upon gripping of the stick shaft between thumb and forefinger.

DESCRIPTION OF PREFERRED EMBODIMENTS

Figure 3:
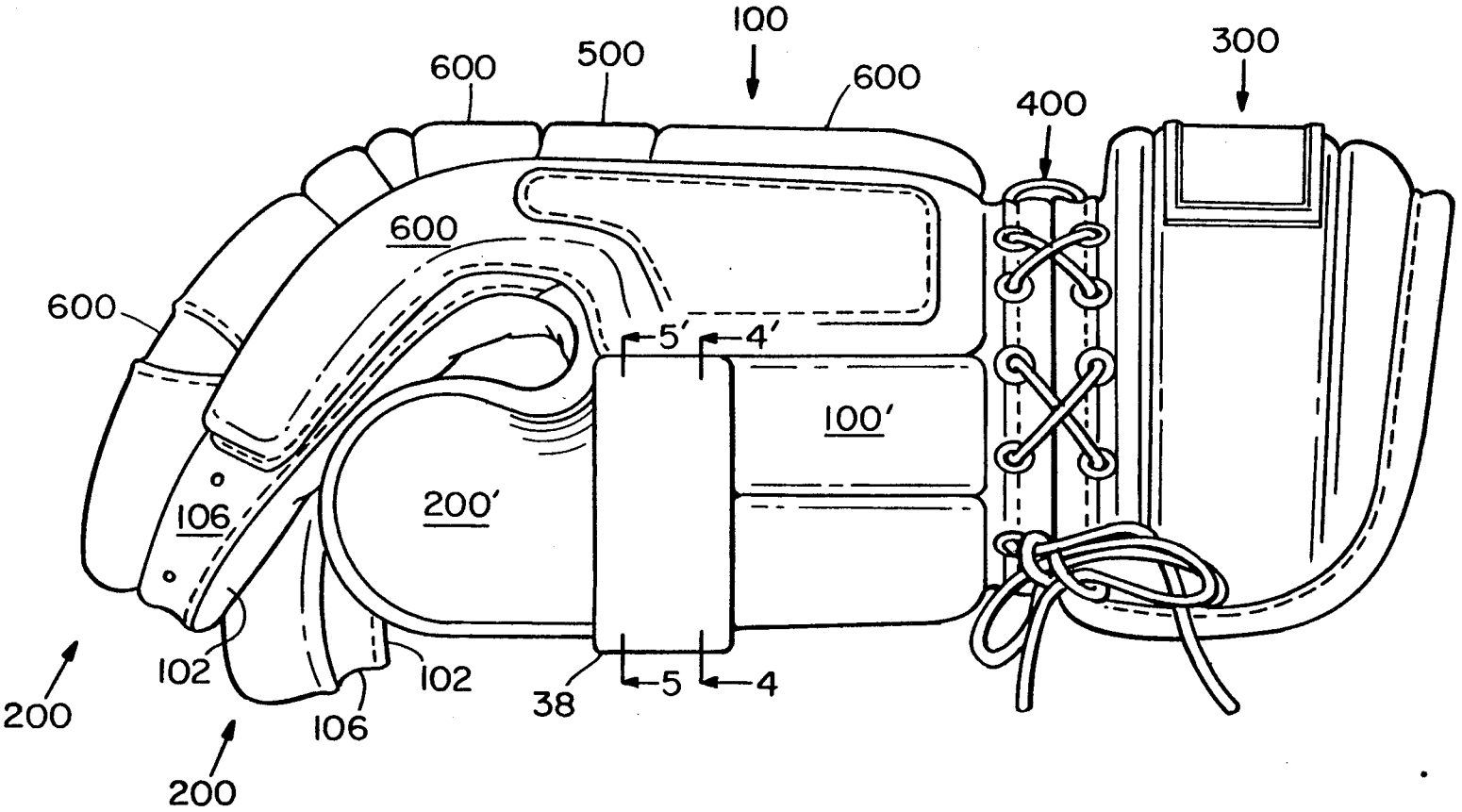
FIG. 3 is a side view of a protective athletic glove comprising the thumb protective construction of the invention.
Figure 4:
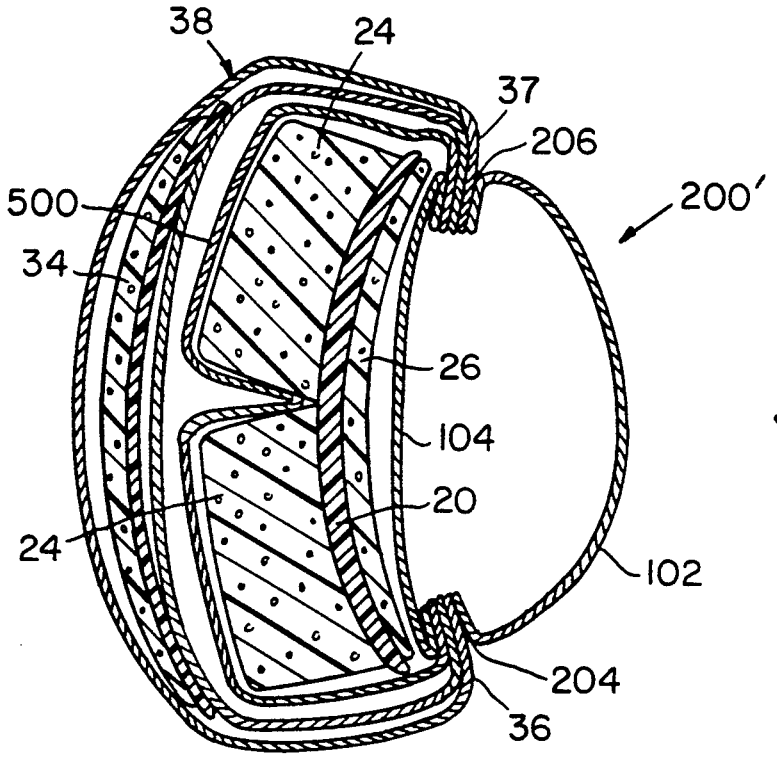
FIG. 4 is a sectional view of the thumb receiving portion of the glove of FIG. 3, taken through lines 4—4' thereof.
Figure 5:
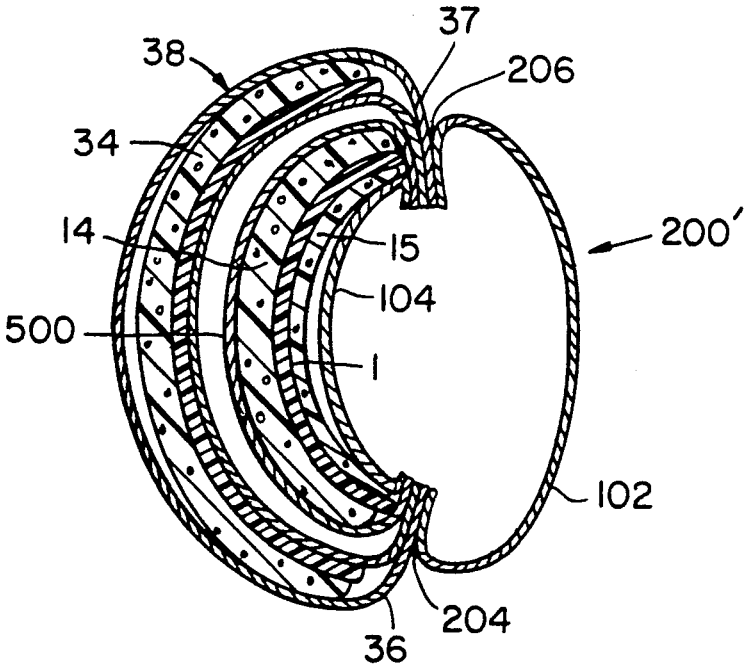
FIG. 5 is a sectional view of the thumb receiving portion of the glove of FIG. 3, taken through lines 5—5' thereof.

Turning now to the drawings, wherein like reference numerals refer to like structures, and with particular reference to FIGS. 3 through 5, a protective athletic glove for contact stick sports generally comprises a hand receiving portion 100, including thumb receiving section 100' thereof, and plural finger receiving stalls 200, including a thumb receiving stall 200'. The glove also normally comprises a protective cuff 300 which is flexibly secured to the opening of the hand receiving portion 100 such as by means of suitable lacing 400. The hand receiving portion 100 and finger stalls 200 are generally defined between a hand-shaped ventral panel 102 and a correspondingly shaped dorsal panel or liner 104. Said ventral panel 102 and overlying corresponding liner 104 are continuously connected at their lateral and distal margins, such as by means of intermediate panel 106, to form therebetween said hand receiving portion 100, including thumb receiving section 100' thereof, and finger receiving stalls 200, including the thumb receiving stall 200'. The wrist ends of the panel 102 and liner 104 are, of course, not connected, thereby to define the hand receiving opening of the glove. Disposed over the back and sides of the glove is a shell 500 composed of a tough, abrasion resistant woven or knitted fabric such as polyester, nylon or the like. Thus, space is provided between the liner 104 and shell 500 of the glove within which one or more impact protective components, illustratively designated at 600, are received. The protective cuff 300 of the glove is constructed in a generally similar manner. However, said cuff 300 does not receive the hand in the sense of a glove. Therefore, the cuff 300 usually lacks the ventral and intermediate panels mentioned above, but does comprise liner and shell layers between which one or more impact protective components are received.

The present invention relates specifically to an improved thumb protective construction for a protective athletic glove of the general type described above. Thus, referring now particularly to FIGS. 1, 2, 4 and 5 hereof, the thumb protective construction of the invention broadly comprises a plurality of stiffening components each constructed of a stiff, impact resistant, sheet form material, said components being particularly arranged in the glove in a cooperative manner. Said stiffening components comprise an elongate distal component 1, an elongate proximal component 20 and an arcuately shaped intermediate component 30. Distal component 1 is of sufficient length and width as to overlie the two phalanges of the thumb and comprises a transverse proximal edge 3. Proximal component 20 is of sufficient length and width as to overlie the metacarpal of the thumb and comprises a transverse distal edge 21. The distal component 1 and proximal component 20 are arranged and secured between the liner and shell of the thumb stall 200' and thumb receiving section 100' of the glove such that the transverse edges 3 and 21 thereof are in an end to end spaced relationship, thereby to define an articulated joint 25 therebetween as is best shown in phantom in FIGS. 1 and 2. The arcuately shaped intermediate component 30 of the construction is disposed over and spaced above said articulated joint 25 and is preferably, but not necessarily, secured exterior of the shell 500 of the glove to the lateral margins of the base of thumb stall 200'. The length of said intermediate stiffening component 30 is sufficient as to maintain said articulated joint 25 positioned thereunder throughout the entire range of motion of said joint 25.

As mentioned previously, each of the stiffening components of the invention is composed of an impact resistant, sheet form material which is preferably of polymeric composition. Many polymeric materials are known which can be formed into suitable stiffening components of the invention possessing the requisite impact resistant properties. For instance, such well known polymer materials as polypropylene, nylon, acrylonitrile-butadiene-styrene copolymers, high density polyethylene, polyesters and the like can generally be readily compounded into impact resistant compositions and formed into the sheet form stiffening components of the invention by known thermoplastic or thermosetting forming techniques.

Distal stiffener component 1 is of one-piece construction and, while the benefits of the invention can be obtained to a substantial degree when its geometry is flat or platelike, it is much preferred that geometry of component 1 be in the general nature of a inverted, preferably round bottomed, trough having a closed distal end 4 such that the descending wall 5 of the inverted trough envelops the lateral and distal aspects of the player's thumb received into the thumb stall 200'. By this preferred inverted trough geometry protection for the lateral and distal aspects of the thumb, as well for the dorsal aspect thereof, is assured.

An important feature of the invention which is structurally and functionally independent of, but cooperative with, the multiple component articulated stiffener arrangement described herein resides in the provision of a medially indwelling bay 2 on the interior margin 7 of the distal stiffener component 1, in other words, on that margin of the distal stiffener component 1 facing the forefinger. Additionally, said bay 2 is located a sufficient distance proximally of the thumb tip 4 such that it is positioned at the level of the proximal phalanx of the thumb, preferably near the base thereof. Said bay 2 is of a size and shape adapted to engage the shaft of the player's stick upon gripping of the stick shaft between thumb and forefinger. Thus, said bay 2 functions to foster a proper gripping position of the stick shaft between the thumb and forefinger of the gripping hand and, once so gripped, to aid in maintaining said proper grip position despite the many external forces which may be applied to the stick during the course of play and which forces can tend to dislodge the stick shaft distally between the thumb and forefinger. As a further consequence, said bay 2 also functions to mitigate against the unsafe levering phenomenon described previously. Preferably, the indwelling bay 2 smoothly transitions into the remainder of the body of the distal stiffener component 1 such that, upon a conscious and affirmative release of the player's grip upon the stick shaft, said stick shaft is free to move smoothly and without interference from its engagement with said bay. With the proviso that the distal stiffening component 1 be at least sufficiently long as to overlie the two phalanges of the thumb, the beneficial functions provided by the indwelling bay 2 feature of the present invention are independent of the length of distal stiffening component 1 employed or the articulated multiple stiffening component arrangement of the invention. Accordingly, in terms of the structure and functions of the indwelling bay 2 feature described above, the thumb stiffener component employed therefor can be substantially longer than that required of the distal stiffening component 1 of the present invention and need not form part of an articulated multiple stiffener component arrangement. Thus, the indwelling bay 2 feature described above can also be beneficially applied to a single unarticulated elongate stiffener component extending proximally from the tip of the thumb to considerably beyond the proximal phalanx of the thumb, such as to those thumb protective stiffener constructions disclosed in the previously mentioned Murray and Jansson et al. patents. In a preferred embodiment of the invention, of course, the indwelling bay 2 feature is combined, and beneficially cooperates, with the articulated multiple stiffening component arrangement of the invention.

Proximal stiffening component 20 can be of one or multiple piece construction and is of a length sufficient to overlie the entire length of the metacarpal of the thumb and is preferably of a width sufficient to overlie the lateral surfaces, as well as the dorsal surface, thereof. In the embodiment of proximal stiffening component 20 shown in FIGS. 1 through 5, hereof, said component is of one-piece construction and its cross sectional geometry is gently arcuate so as to approximate the curvature of the soft tissues overlying the dorsal and lateral surfaces of the metacarpal of the thumb. However, a satisfactory equivalent of the arcuate one-piece proximal stiffening component 20 specifically shown in FIGS. 1 through 5 hereof can be had by constructing said component 20 of multiple elongate plate form elements.

Figure 6:
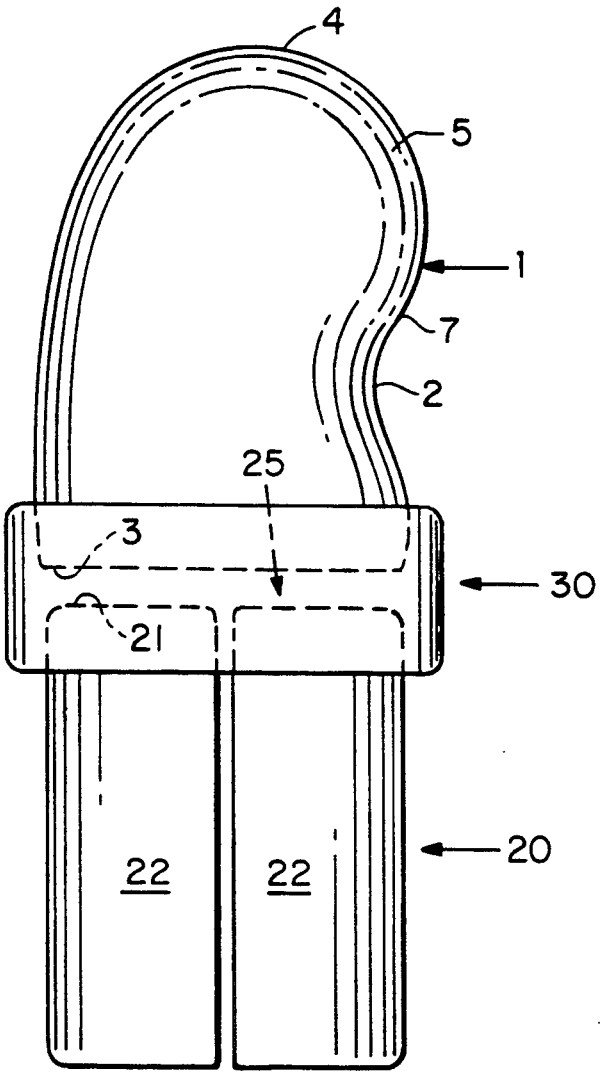
FIG. 6 is a schematic partially phantom plan view of the protective stiffener components of the thumb protective construction of the invention showing an alternate construction of the proximal component thereof.

Referring now to FIG. 6, there is shown a proximal stiffening component 20 comprising a plurality of elongate plate form elements 22 arranged in side by side relationship, each said element 22 being of substantially narrower width than the desired overall width of the component 20. Said plural plate form elements 22 can be laid into the thumb receiving section of the glove in side by side longitudinally articulated relationship and secured therein such that they share a common distal margin 21 which is spaced from the proximal margin 3 of the distal stiffener component 1 so as to define the articulated joint 25 therebetween. Where such a plural element proximal stiffener component 20 construction is employed we generally prefer that it comprise two plate form elements 22 of equal width.

Arcuately shaped intermediate stiffening element 30 is of sufficient width as to span the entirety of the articulated joint 25 defined between the distal and proximal stiffening components 1 and 20 and is of sufficient length such as to assure that it will remain disposed entirely over said joint 25 during the full range of flexure thereof. As to this last, it will be appreciated that the minimum distance or spacing between the margins 3 and 21 of distal and proximal stiffening components 1 and 20 occurs when the thumb stall 200' of the glove is in the fully extended, unflexed condition. However, when said thumb stall is flexed downwardly, such as when the thumb enclosed therein is curled into a gripping posture, the articulated joint 25 will tend to open, thereby increasing the spacing between said margins 3 and 21. Thus, it is important that the length of the arcuately shaped intermediate stiffening component 30 disposed over said joint 25 be sufficient to fully accommodate this change in spacing as a function of flexure of the thumb stall 200'. The curvature of the arcuately shaped intermediate stiffening component 30 is suitably adapted to maintain said component 30 out of interfering contact with the articulated joint 25 during flexure thereof.

In another preferred embodiment of the thumb protective construction of the invention, as may best be seen in FIGS. 4 and 5, the exteriormost surface of distal stiffening component 1 comprises a continuous resilient impact energy absorptive padding element 14 disposed thereover, the proximal stiffening component 20 comprises one or more resilient impact energy absorptive padding elements 24 disposed over the exteriormost surface thereof and the intermediate arcuately shaped stiffening element 30 comprises a continuous resilient impact energy absorptive padding element 34 disposed over the exteriormost surface thereof. In an even more preferred construction of the invention, the distal stiffening component 1 and the proximal stiffening component 20 additionally comprise continuous resilient impact energy absorptive padding elements 15 and 26, respectively, disposed over the interior surfaces thereof. The preferred impact absorptive material utilized in the construction of said padding elements is a resilient polymeric foam material such as sponge rubber or a polyurethane or polyvinylchloride foam. While not a requisite of the invention, for purposes of construction and assembly ease and security it is further preferred that each of the above-mentioned padding elements be continuously secured to its respective stiffener component surface such as by bonding or adhesive cementing thereto.

Figure 1:
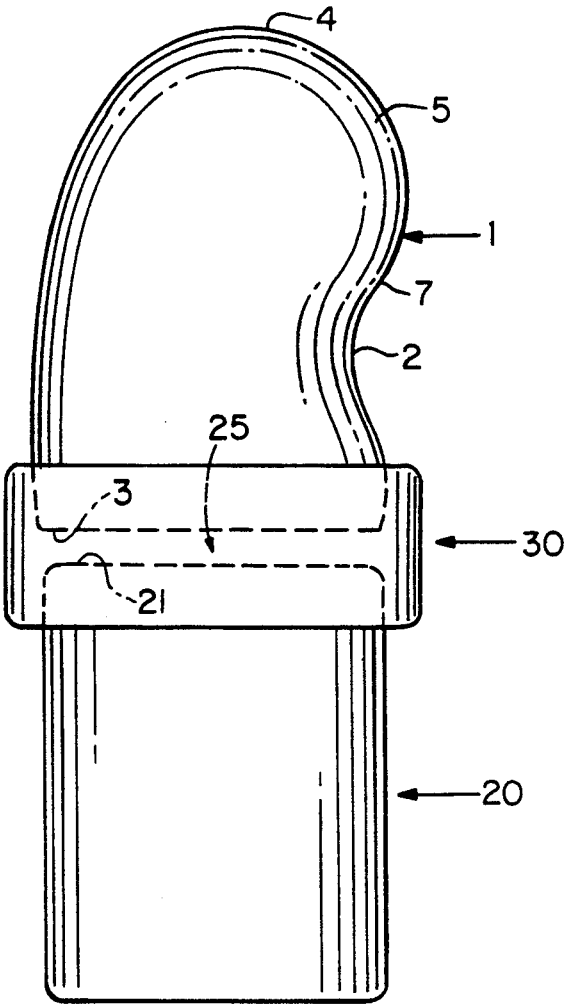
FIG. 1 is a schematic partially phantom plan view of the protective stiffener components of the thumb protective construction of the invention showing said components as arranged in a protective athletic glove.
Figure 2:
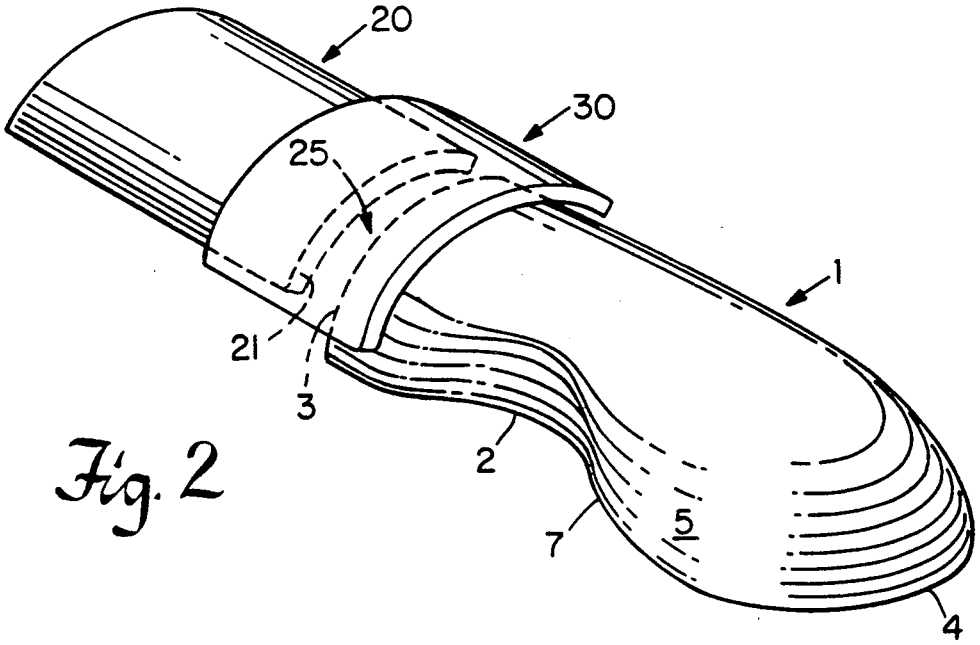
FIG. 2 is perspective partially phantom view of the protective stiffener component arrangement of FIG. 1.

Referring now particularly to FIGS. 1, 4 and 5, the distal stiffening component 1 and proximal stiffening component 20, and, if utilized, the preferred padding elements 14, 24, 15 and 26 associated therewith are appropriately positioned and secured between the liner 104 and shell 500 of the thumb stall 200' and the thumb receiving section 100' of hand receiving portion 100 of the glove in an end to end relationship and with the transverse proximal margin 3 of distal stiffening component 1 sufficiently spaced from the distal margin 21 of proximal stiffening component 20 as to define articulated joint 25 therebetween. The arcuately shaped intermediate element 30 is preferably disposed exteriorly of shell 500 of the glove and is spaced over the articulated joint 25 defined between stiffening distal and proximal components 1 and 20. Said intermediate stiffening component 30 is secured to the sides of the base of the thumb stall 200'. Where the intermediate stiffening component 30 is secured exteriorly of the shell 500, a convenient construction by which said arcuately shaped intermediate component 30 can be so secured to the glove is in the nature of a fabric tube 38 which receives therewithin the intermediate stiffener component 30 and, if employed, the preferred impact absorptive padding element 34 disposed over the exterior surface thereof. Said tube 38 is preferably composed of a fabric material similar to that utilized for the shell 500 of the glove and is of a length greater than the width of the intermediate stiffener component 30 such that free ends 36 and 37 result which overhang the ends of the enclosed stiffener component 30. Said free ends 36 and 37 are secured to the sides of the thumb stall 200', such as at lateral seams 204, 206 thereof. By this construction the intermediate stiffener component 30 is secured in a stable, but non-interfering position over the articulated joint 25.

The foregoing specification and the drawings forming part hereof are illustrative in nature and demonstrate certain preferred embodiments of the invention. It should be recognized and understood, however, that said description is not to be construed as limiting of the invention because many changes, modifications and variations may be made therein by those of skill in the art without departing from the essential scope, spirit or intention of the invention. Accordingly, it is intended that the scope of the invention be limited solely by the appended claims.

What is claimed is:

1. In a protective athletic glove having a thumb receiving section and a thumb stall, the thumb protective construction comprising an arrangement of protective stiffening components each being composed of an impact resistant sheet form material, said arrangement comprising:

(A) an elongate distal stiffener component having a length sufficient to overlie the phalanges of the thumb, said distal stiffener component having proximal and interior margins and being dorsally secured in the thumb stall of the glove;

(B) an elongate proximal stiffener component having a length sufficient to overlie the metacarpal of the thumb, said proximal stiffener component having a distal margin and being dorsally secured in the thumb receiving section of the glove in an end to end relationship with the distal stiffener components of (A), the distal margin of said proximal stiffener component being spaced proximally of the proximal margin of said distal stiffener component so as to define an articulated joint therebetween; and (C) an arcuately shaped intermediate stiffener component disposed and secured over said articulated joint and in spaced relationship thereabove, said intermediate stiffener component having a width sufficient to span said joint and a length sufficient to entirely overlie said joint throughout the full range of flexure thereof.

2. The thumb protective construction of claim 1 wherein said distal stiffening component comprises a medially indwelling bay on the interior margin thereof, said bay being located sufficiently proximally of the distal end of said distal stiffening component as to be positioned at the level of the proximal phalanx of a thumb received into said thumb stall, said bay additionally being of a size and shape adapted to engage the shaft of a stick gripped between the thumb and forefinger.

3. The thumb protective construction of claim 2 wherein said medially indwelling bay transitions smoothly into the body of said distal stiffening component.

4. The thumb protective construction of claim 2 wherein said medially indwelling bay is located near the base of said proximal phalanx of the thumb.

5. The thumb protective construction of claim 1 wherein the geometry of said distal stiffening component is in the general nature of an inverted trough having interior and exterior side walls and a closed distal end wall, thereby to enclose the lateral and distal aspects of a thumb received into said thumb stall.

6. The thumb protective construction of claim 5 wherein said distal stiffening component comprises a medially indwelling bay on the interior side wall thereof, said bay being located sufficiently proximally of the distal end of said distal stiffening component as to be positioned at a level corresponding to the proximal phalanx of a thumb received into said thumb stall, said bay being of a size and shape adapted to engage the shaft of a stick gripped between the thumb and forefinger.

7. The thumb protective construction of claim 6 wherein said medially indwelling bay transitions smoothly into the interior side wall of said distal stiffening component.

8. The thumb protective construction of claim 6 wherein said medially indwelling bay is located near the base of said proximal phalanx of the thumb.

9. The thumb protective construction of claim 1 wherein said proximal stiffening component is of one-piece construction.

10. The thumb protective construction of claim 9 wherein the cross sectional geometry of said one-piece proximal stiffening component is gently arcuate, thereby to approximate the curvature of the soft tissues overlying the metacarpal of the thumb.

11. The thumb protective construction of claim 1 wherein said proximal stiffening component comprises a plurality of elongate plate form elements positioned and secured dorsally within the thumb receiving section of the glove in side by side articulated relationship, the distal ends of said elements defining a common distal margin.

12. The thumb protective construction of claim 1 wherein each of said stiffening components comprises at least one resilient impact energy absorptive padding element disposed over the exterior surface thereof.

13. The thumb protective construction of claim 12 wherein each said padding element is continuously secured to the surface of the stiffening component associated therewith.

14. The thumb protective construction of claim 1 wherein said distal and proximal stiffening components each comprise a continuous resilient impact energy absorptive padding element disposed over the interior surface thereof.

15. The thumb protective construction of claim 14 wherein each said continuous resilient impact energy absorptive padding element is continuously secured to the surface of the stiffening component associated therewith.

16. The thumb protective construction of claim 1 wherein said arcuately shaped intermediate stiffener component is secured to the lateral margins of the base of said thumb stall, exteriorly thereof.

17. The thumb protective construction of claim 16 wherein said arcuately shaped intermediate stiffener component is secured to the lateral margins of said thumb stall by means of a fabric tube receiving said arcuately shaped intermediate stiffener component therein, the length of said fabric tube being greater than the width of said component, thereby to define free ends of said tube extending to either side of said component, said free ends of said fabric tube being secured to the lateral margins of said thumb stall.

18. In a protective athletic glove having a thumb receiving section and a thumb stall, a thumb protective construction comprising an elongate distal stiffener component composed of a sheet form impact resistant material and having a length at least sufficient to overlie the phalanges of the thumb, said stiffener component being dorsally secured in the thumb stall of the glove, a medially indwelling bay formed on the interior margin of said distal stiffener component, said bay being located sufficiently proximal of the distal end of said component as to be positioned at the level of the proximal phalanx of a thumb received into said thumb stall, said bay additionally being of a size and shape adapted to engage the shaft of a stick gripped between the thumb and forefinger.

19. The thumb protective construction of claim 18 wherein said medially indwelling bay transitions smoothly into the body of said distal stiffening component.

20. The thumb protective construction of claim 18 wherein said medially indwelling bay is located near the base of said proximal phalanx of the thumb.

21. The thumb protective construction of claim 18 wherein the geometry of said distal stiffening component is in the general nature of an inverted trough having side walls and a closed distal end wall, thereby to enclose the lateral and distal aspects of a thumb received into said thumb stall and said medially indwelling bay is formed on the interior side wall thereof.

22. The thumb protective construction of claim 21 wherein said medially indwelling bay transitions smoothly into the interior side wall of said distal stiffening component.

23. The thumb protective construction of claim 21 wherein said medially indwelling bay is located near the base of said proximal phalanx of the thumb.

24. The thumb protective construction of claim 18 wherein the length of said distal stiffener component is at least sufficient to overlie the phalanges and at least a portion of the metacarpal of the thumb.

* * * * *